United States Patent [19]

Simpson

[11] 4,223,588

[45] Sep. 23, 1980

[54] PRIMER FEED DEVICE

[76] Inventor: Frank H. Simpson, Rt. 2 Box 276, Cornelius, Oreg. 97113

[21] Appl. No.: 31,765

[22] Filed: Apr. 20, 1979

[51] Int. Cl.[3] ..... F42B 33/00

[52] U.S. Cl. ..... 86/45; 86/23

[58] Field of Search ..... 86/23, 45

[56] References Cited

U.S. PATENT DOCUMENTS

| | | | |
|---|---|---|---|
| 3,153,977 | 10/1964 | Dicken | 86/45 X |
| 3,349,663 | 10/1967 | Slee | 86/23 X |
| 3,714,860 | 2/1973 | Leich | 86/23 X |
| 3,973,465 | 8/1976 | Bachhuber et al. | 86/23 X |
| 4,020,737 | 5/1977 | Ranson | 86/23 |

*Primary Examiner*—Leland A. Sebastian

*Attorney, Agent, or Firm*—Francis Swanson

[57] ABSTRACT

A device for feeding primers to a cartridge reloading tool is disclosed. The invention comprises an upright frame having a primer holding tray at its upper end. The frame is hollow and defines a passageway for a chain. The lower end of the frame attaches to the primer inserting device on the reloading tool. Associated with the primer holding tray are two primer feed rolls which are spring loaded and actuated by the chain within the frame. The chain is operatively connected at its lower end to the handle of the reloading tool. As the operator actuates the handle to effect the loading sequence, the primer feed rolls rotate and progressively feed fresh primers into a chute attached to the frame and primer tray.

10 Claims, 4 Drawing Figures

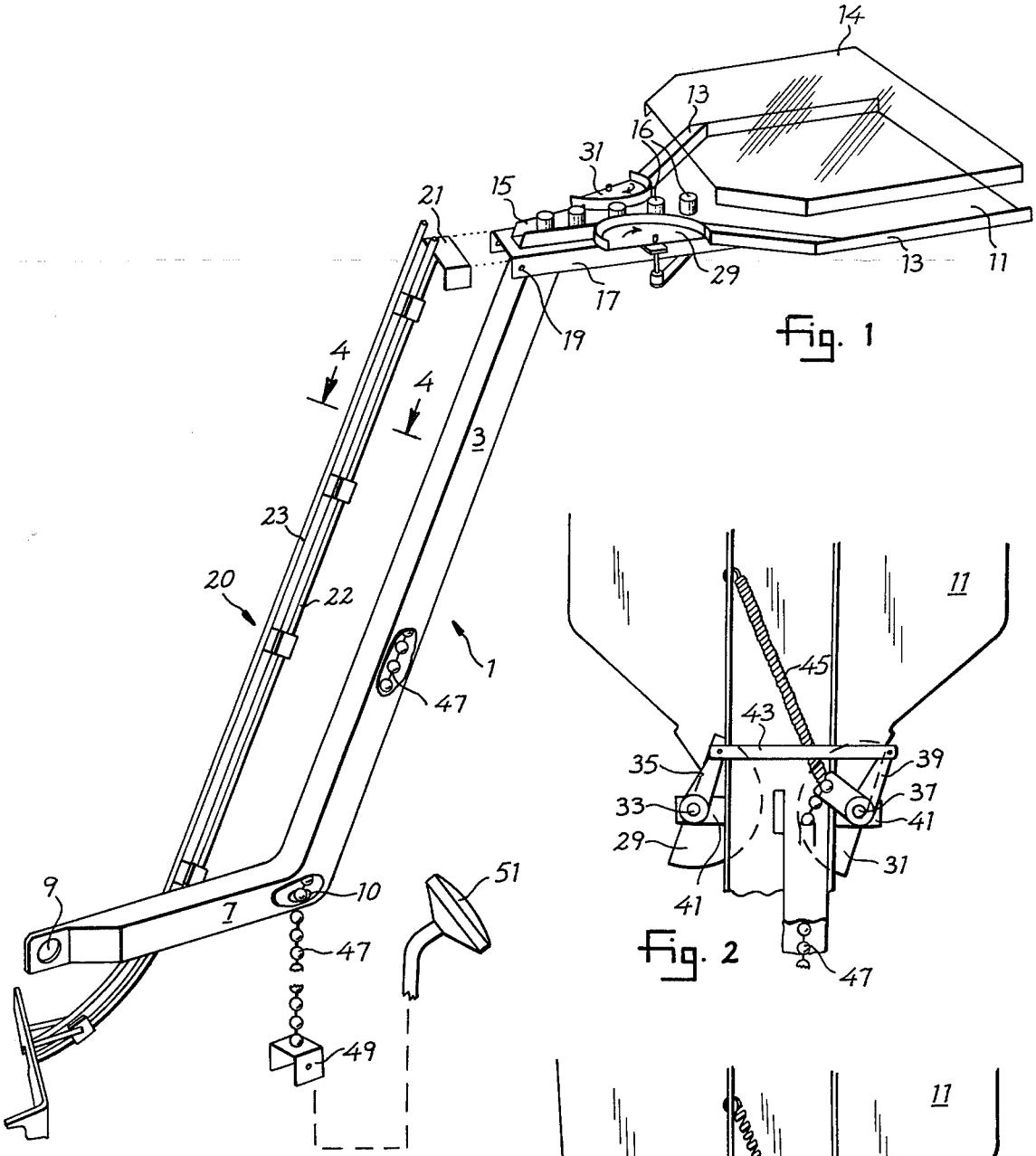
Fig. 1
Fig. 2
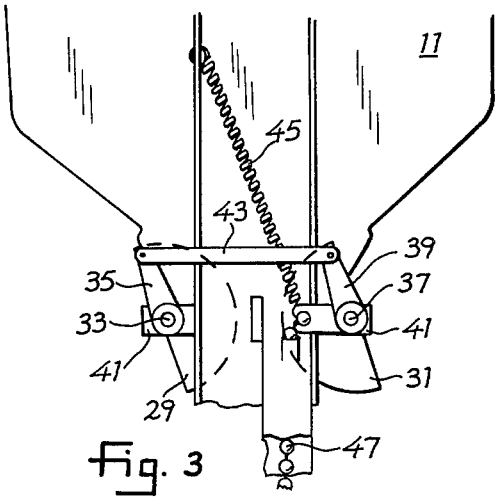
Fig. 3
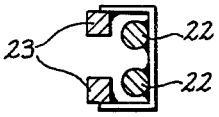
Fig. 4

PRIMER FEED DEVICE

BACKGROUND OF THE INVENTION

1. Field of the Invention

The invention relates to primer feeding devices in general, and more particularly to those having plural feed rolls for guiding primers from a holding tray to the loading device.

2. Description of the Prior Art

Numerous primer feeding devices exist in the prior art. Typical illustrations include U.S. Pat. Nos. 2794359 to Lyman et al, 3,152,508 to Fratila and 3,240,103 to Lamont. Some examples of feeding mechanisms which include primer trays and chutes are 3,320,848 to Ponsness and 3,973,465 to Bachhuber et al. Drawbacks in the prior art include the inability to feed primers at the uniform rate and to automatically provide primers which are always properly oriented for insertion into the cartridge being reloaded. The present invention solves this problem by providing a closable primer tray and plural feed rolls which always insure a uniform feed rate and proper orientation of the primers.

OBJECTS AND ADVANTAGES

It is the principal object of the invention to provide a means for feeding primers uniformly and in proper orientation to the inserting tool of a cartridge reloader.

A further object of the invention is to provide a primer feed mechanism having a plurality of feed rolls for directing primers into a feed chute.

A further object of the invention is to provide a closed primer tray having a transparent cover so that the quantity and orientation of the primers in the tray is always ascertainable.

Further objects and advantages of the invention will be apparent to those skilled in the art having reference to the accompanying drawings and specification.

BRIEF DESCRIPTION OF THE DRAWINGS

FIG. 1 is a top perspective view of the device partially exploded and broken away to illustrate the details of construction.

FIG. 2 is a bottom plan view of a portion of the primer holding tray frame, and the associated primer feed rolls illustrating the construction thereof.

FIG. 3 is the plan view of FIG. 2 showing the feed rolls after one cycle.

FIG. 4 is a sectional view of the primer chute taken along line 4—4 of FIG. 1.

DETAILED DESCRIPTION

Referring now to the drawings, the primer feeder comprises a hollow frame generally indicated by the numeral 1. Frame 1 comprises a hollow vertical member 3 which defines a chain guide 5 at its upper end. A horizontal mounting foot 7 is attached to vertical member 3 and defines a mounting eye 9 and chain exit hole 10. On the upper end of vertical member 3 is mounted primer tray 11. Tray 11 includes upperwardly turned edges 13 to which is attached a transparent cover 14. Tray 11 defines a U-shaped upwardly turned primer feed throat 15. A series of primers 16 are shown on tray 11. Tray 11 is mounted on a channel shaped frame 17 which defines a plurality of mounting holes 19. A primer feed chute 20 is operatively connected to channel frame 17 via bracket 21. Chute 20 includes primer slides 22, and guides 23 which are held in place by brackets 25. Chute 20 terminates at its lower end in a generally L-shaped mounting yoke 27 which attaches to the primer inserting device (not shown) on the reloading tool.

Operatively associated with primer tray 11 are two primer feed rolls 29 and 31. Feed roll 29 is mounted on shaft 33 which is connected to an actuating lever 35. Feed roll 31 is similar, and is mounted on shaft 37 to which is attached actuating lever 39. Levers 35 and 39 operatively connected to frame 17 with via mounting ears 41. Levers 35 and 39 are pivotally connected to one another by tie bar 43. Lever 39 is loaded by return spring 45. Also connected to lever 39 is chain 47 which runs from lever 39 through chain guide 5 at the upper end of frame 1 and exits through hole 10. On the end of chain 47 is a bracket 49 which is operatively connected to the actuating lever 51 of the loading machine. This is shown schematically in FIG. 1. It will be understood by those who are ordinarily skilled in the art that the connection of bracket 49 through handle 51 may be either direct or indirect, and thus is shown schematically.

OPERATION

Assume now that the primer feeder is operatively connected to a cartridge loading machine by the attachment of foot 7 thereto through eye 9. Assume further that chute 20 is operatively connected to the primer inserting device via yoke 27 so that primers descending through chute 20 feed normally into the primer inserting device.

The operator now begins the loading sequence by movement of handle 51. This pulls chain 41 down the hollow portion of vertical member 3. This pulling acton causes lever 39 to rotate about shaft 37. Because lever 35 is operatively connected to lever 39 via tie bar 43, lever 35 will pivot in the same direction about its shaft as does lever 39. The pivotal motion of levers 35 and 39 will cause feed rolls 29 and 31 to rotate in the same direction. This rotating motion will cause a primer 16 to move through the space between rolls 29 and 31 and rotate into feed throat 15. Further actuation of the handle repeats the cycle and brings another primer 16 through the space between rolls 29 and 31 into throat 15. Successive feeding of primers 16 from tray 11 into throat 15 eventually forces the primers to slide down chute 20 on slides 21 and into the primer inserting device (not shown).

After each cycle, the operator will move handle 51 back to its original position. This will release the tension in chain 47. Return spring 45 will now act on lever 39 and cause rolls 29 and 31 to pivot back to their original positions. Actuation of handle 51 by the operator will begin a new loading sequence.

Having illustrated my invention and described it in detail, it will be apparent to those skilled in the art that many modifications could be made without departing from the true spirit and scope of the invention. I claim as my invention all such modifications as fall within the true spirit and scope of the appended claims.

I claim:

1. A primer feeding device for a cartridge reloading machine comprising:

a frame;

primer holding means on the frame;

a pivotable primer feed roll operatively connected to the primer holding means;

and means for directing a primer from the primer holding means to the reloading machine.

2. Apparatus according to claim 1 wherein the pivotable roll is operatively connected to a chain attached to the loading machine.

3. Apparatus according to claim 1 including a first and second feed roll, both rolls rotatable in the same direction relative to the primer holding means.

4. Apparatus according to claim 3 wherein the primer feed rolls are operatively connected to a return spring attached to the primer holding means.

5. A primer feeding device for a cartridge reloading machine comprising:

a frame;

a primer holder on the frame;

a plurality of primer feed rolls operatively attached to the primer holder, the rolls pivotable in the same direction relative to the primer holder;

and a primer directing chute operatively connected to the primer holder and to the loading machine.

6. The construction of claim 5 wherein the primer holder is a tray.

7. The construction of claim 6 wherein the tray is optionally closable with a transparent lid.

8. The construction of claim 5 wherein the rolls pivot under the influence of a flexible chain operatively connected to the reloading machine.

9. A primer feeding device detachably connected to a cartridge reloading machine comprising:

a primer holding tray;

a plurality of pivotable rolls operatively attached to the tray in spaced apart relation, the rolls pivotable in the same direction relative to the primer holding tray;

and a primer directing chute connected to the tray and to the reloading machine.

10. Apparatus according to claim 9 wherein the rolls are connected to one another and to a return spring interposed between the rolls and the tray.

* * * * *